US008166928B2

(12) United States Patent
Moro

(10) Patent No.: US 8,166,928 B2
(45) Date of Patent: May 1, 2012

(54) PRESSURIZED AIR VARIABLE COMPRESSION RATIO ENGINE SYSTEM

(75) Inventor: Carlos Villarreal Moro, Portales (MX)

(73) Assignee: Ford Global Technologies, LLC, Dearborn, MI (US)

( * ) Notice: Subject to any disclaimer, the term of this patent is extended or adjusted under 35 U.S.C. 154(b) by 756 days.

(21) Appl. No.: 12/266,086

(22) Filed: Nov. 6, 2008

(65) Prior Publication Data

US 2010/0108037 A1 May 6, 2010

(51) Int. Cl.
*F02B 75/04* (2006.01)

(52) U.S. Cl. ..... 123/48 B; 123/48 R; 123/48 A; 123/78 B; 123/78 R; 123/78 BA

(58) Field of Classification Search ..... 123/48 R, 123/48 B, 78 B, 78 R, 78 BA
See application file for complete search history.

(56) References Cited

U.S. PATENT DOCUMENTS 4,241,705 A 12/1980 Karaba et al.
5,755,192 A 5/1998 Brevick
6,732,041 B2 * 5/2004 Cullen ..... 701/103
6,814,064 B2 * 11/2004 Cowans ..... 123/559.1
6,901,892 B2 * 6/2005 Mavinahally et al. ..... 123/73 V
6,925,971 B1 * 8/2005 Peng et al. ..... 123/46 R
6,948,459 B1 * 9/2005 Laumen et al. ..... 123/46 R
7,017,536 B2 * 3/2006 Scuderi ..... 123/70 R
7,066,118 B2 6/2006 Hirano
7,146,940 B2 12/2006 Knutsen
7,318,397 B2 1/2008 Ward

* cited by examiner

*Primary Examiner* — Noah Kamen
*Assistant Examiner* — Long T Tran
(74) *Attorney, Agent, or Firm* — James Dottavio; Alleman Hall McCoy Russell & Tuttle LLP

(57) ABSTRACT

A system for controlling a variable compression ratio in an engine is provided. The system includes a cylinder, an outer piston located inside the cylinder, the cylinder and the outer piston collectively defining a combustion chamber, an inner piston, variably positioned inside the outer piston, the outer piston and the inner piston collectively defining an auxiliary chamber, a connecting rod including an air duct in fluid communication with the auxiliary chamber, and a crankshaft including an air passage in fluid communication with the air duct of the connecting rod during at least a portion of an engine cycle.

20 Claims, 8 Drawing Sheets

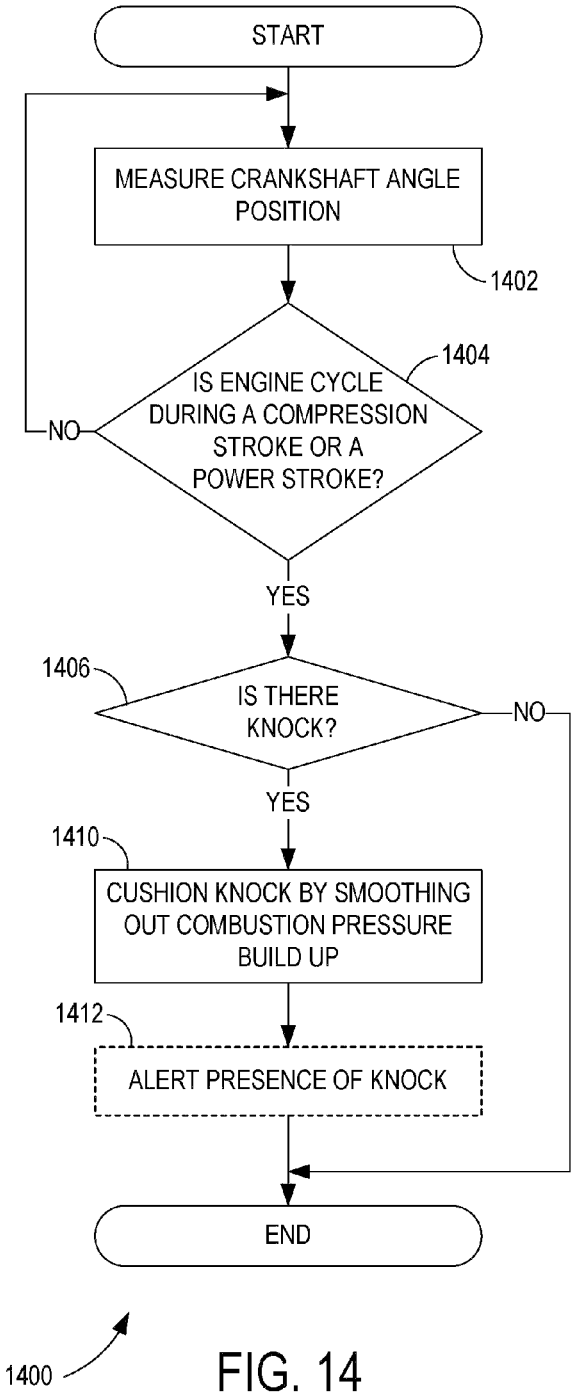
FIG. 14
FIG. 16
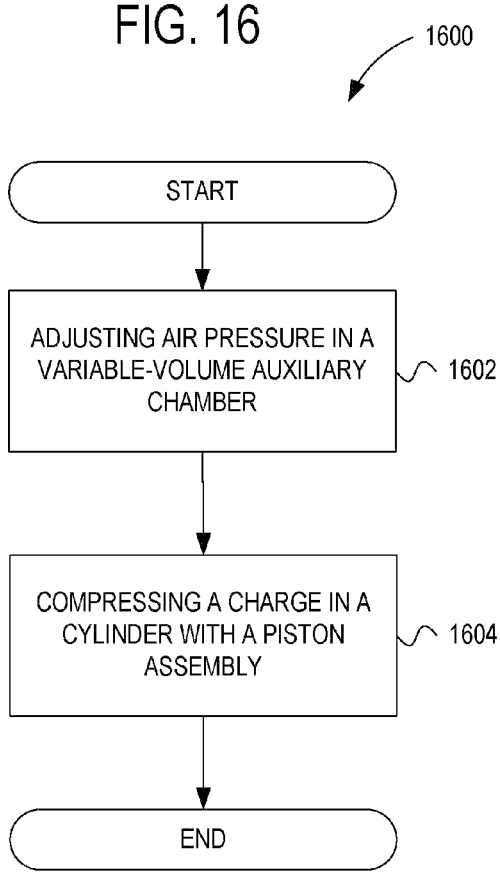

PRESSURIZED AIR VARIABLE COMPRESSION RATIO ENGINE SYSTEM

FIELD

The present application relates to a system for controlling a variable compression ratio in an internal combustion engine to increase engine efficiency.

BACKGROUND AND SUMMARY

During operation, an internal combustion engine may compress charge, air, or a mixture of air and fuel, according to an engine's compression ratio, before ignition. A low charge in an engine, and hence a partial engine load, may lead to lower effective compression than predicted by a compression ratio. Further, a lower effective compression ratio may result in a loss of engine efficiency and thus fuel economy.

U.S. Pat. No. 4,241,705 describes a piston within another piston, hydraulically controlled by oil pumped from a crankcase, for changing a variable compression ratio in an internal combustion engine. Oil may be vented from a chamber to inhibit compression pressure from reaching a damaging level, and gradual pumping may be performed to change a compression ratio to a predetermine value. Alternately, an engine block may be modified to include additional systems and devices for controlling the volume of an engine cylinder.

The inventors herein have recognized various issues related to such approaches. A desired effective compression ratio may be hard to obtain with a hydraulically controlled piston within another piston. Gradual pumping may inhibit changing a variable compression ratio in response to quickly changing engine loads, rendering the system unresponsive. Further, engine block modifications may require impractical and complicated engine configurations. Further still, hydraulic systems and modified engine blocks may have limited anti-knock characteristics.

Accordingly, systems and methods are disclosed for controlling a variable compression ratio. As one approach, a system for controlling a variable compression ratio in a cylinder, including a combustion chamber, is provided. The system includes, an outer piston disposed inside the cylinder, an inner piston, disposed inside the outer piston, an auxiliary chamber located between the inner piston and the outer piston, a pressurized air passage for filling pressurized air into the auxiliary chamber, and a connecting rod including an air duct, for enabling the filling of the auxiliary chamber with pressurized air from the pressurized air passage. Such a system may not require costly and complicated engine block modifications or additional systems for variable compression ratio control. By modulating air pressure in the auxiliary chamber, it may be easy to control the compression ratio to a desired effective compression ratio. Further, the auxiliary chamber may act as an air cushion to reduce or prevent pressure increases that result in knock in the combustion chamber.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE FIGURES

FIG. 14 shows an example subroutine for carrying out a method of preventing a damaging pressure increase (e.g., knock) in the combustion chamber.

FIG. 16 shows an example method for changing an effective compression ratio in an internal combustion engine.

DETAILED DESCRIPTION OF THE FIGURES

A system for controlling a variable compression ratio and related methods and systems are described below. The system for controlling a variable compression ratio may be integrated into an internal combustion engine. As one example, a four stroke, spark ignition, gasoline engine may be referred to throughout the disclosure herein. It should be noted that the system for controlling a variable compression ratio as described and illustrated below may also be integrated into alternate engines. Some such engines include two stroke engines, alternate spark ignition engines, diesel engines and other compression ignition engines, for example homogeneous charge compression ignition (HCCI) engines.

Figure 1:
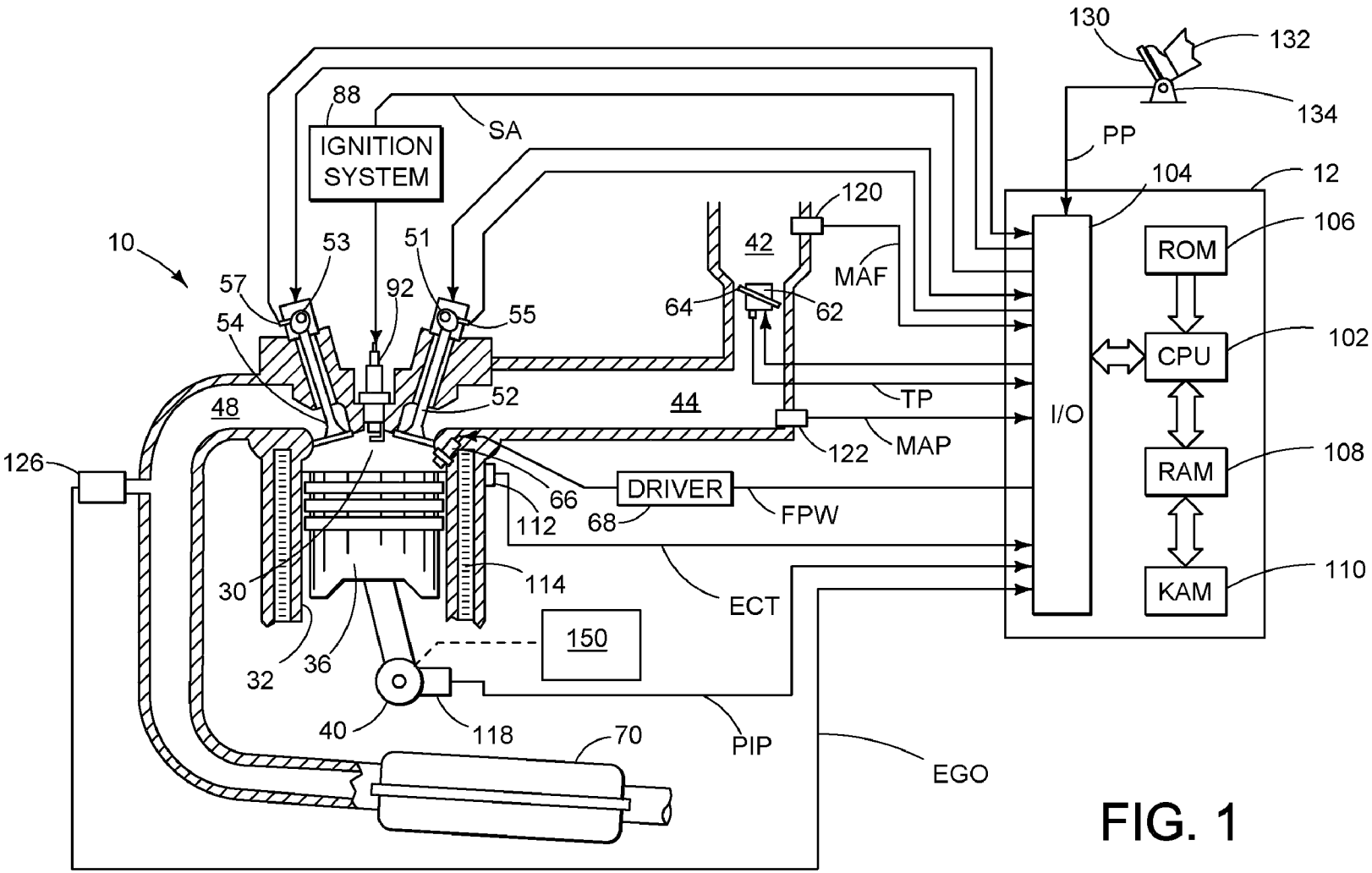
FIG. 1 is an example engine which may include a system for controlling a variable compression ratio.

FIG. 1 is a schematic diagram showing one cylinder of multi-cylinder engine 10, which may be included in a propulsion system of an automobile. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. Combustion chamber (i.e. cylinder) 30 of engine 10 may include combustion chamber walls 32 with piston 36 positioned therein. The cylinder 30 may have a maximum volume, which may be a cylinder displacement, or cylinder displacement volume. Piston 36 may be coupled to crankshaft 40, for example via a connecting rod, so that reciprocating motion of the piston is translated into rotational motion of the crankshaft. The piston 36 may include, or be included in, a pressurized air system for controlling a variable compression ratio in a cylinder, for example cylinder 30. Further the piston 36 may be an outer piston of a piston-in-piston, described in more detail below.

Crankshaft 40 may be coupled to at least one drive wheel of a vehicle via an intermediate transmission system. Further, a crankshaft angle position sensor, such as a Hall Effect sensor 118 or variable reluctance sensor may be coupled to the crankshaft. A crankshaft angle position sensor may measure the phase, angular position of the crankshaft, and/or stroke of the engine cycle (i.e., engine cycle timing). An angular distance from a reference point, such as top dead center (TDC) or bottom dead center (BDC) may be used to determine a relative angular position. The angular distance from a reference point, and signals about valve position, may determine the engine cycle timing. Further still, a starter motor may be coupled to crankshaft 40 via a flywheel to enable a starting operation of engine 10.

Combustion chamber 30 may receive intake air from intake manifold 44 via intake passage 42 and may exhaust combustion gases via exhaust passage 48. Intake manifold 44 and exhaust passage 48 can selectively communicate with combustion chamber 30 via respective intake valve 52 and exhaust valve 54. In some embodiments, combustion chamber 30 may include two or more intake valves and/or two or more exhaust valves.

In this example, intake valve 52 and exhaust valves 54 may be controlled by cam actuation via respective cam actuation systems 51 and 53. Cam actuation systems 51 and 53 may each include one or more cams and may utilize one or more of cam profile switching (CPS), variable cam timing (VCT), variable valve timing (VVT) and/or variable valve lift (VVL) systems that may be operated by controller 12 to vary valve operation. The position of intake valve 52 and exhaust valve 54 may be determined by position sensors 55 and 57, respectively. Position sensors may be used, at least in part, to determine and/or measure engine cycle timing. For example, a crankshaft angle position and a position of a valve may be used to determine if an engine is in a particular stroke of an engine cycle (e.g., admission, compression, power, and exhaust). In alternative embodiments, intake valve 52 and/or exhaust valve 54 may be controlled by electric valve actuation. For example, cylinder 30 may alternatively include an intake valve controlled via electric valve actuation and an exhaust valve controlled via cam actuation including CPS and/or VCT systems.

Fuel injector 66 is shown coupled directly to combustion chamber 30 for injecting fuel directly therein in proportion to the pulse width of signal FPW received from controller 12 via electronic driver 68. In this manner, fuel injector 66 provides what is known as direct injection of fuel into combustion chamber 30. The fuel injector may be mounted in the side of the combustion chamber or in the top of the combustion chamber, for example. Fuel may be delivered to fuel injector 66 by a fuel system (not shown) including a fuel tank, a fuel pump, and a fuel rail. In some embodiments, combustion chamber 30 may alternatively or additionally include a fuel injector arranged in intake passage 44 in a configuration that provides what is known as port injection of fuel into the intake port upstream of combustion chamber 30.

Intake passage 42 may include a throttle 62 having a throttle plate 64. In this particular example, the position of throttle plate 64 may be varied by controller 12 via a signal provided to an electric motor or actuator included with throttle 62, a configuration that is commonly referred to as electronic throttle control (ETC). In this manner, throttle 62 may be operated to vary the intake air provided to combustion chamber 30 among other engine cylinders. The position of throttle plate 64 may be provided to controller 12 by throttle position signal TP. Intake passage 42 may include a mass air flow sensor 120 and a manifold air pressure sensor 122 for providing respective signals MAF and MAP to controller 12.

Ignition system 88 can provide an ignition spark to combustion chamber 30 via spark plug 92 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

Exhaust gas sensor 126 is shown coupled to exhaust passage 48 upstream of emission control device 70. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. Emission control device 70 is shown arranged along exhaust passage 48 downstream of exhaust gas sensor 126. Device 70 may be a three way catalyst (TWC), NOx trap, various other emission control devices, or combinations thereof. In some embodiments, during operation of engine 10, emission control device 70 may be periodically reset by operating at least one cylinder of the engine within a particular air/fuel ratio.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure signal, MAP, from sensor 122. Engine speed signal, RPM, may be generated by controller 12 from signal PIP. Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, sensor 118, which is also used as an engine speed sensor, may produce a predetermined number of equally spaced pulses every revolution of the crankshaft.

Storage medium read-only memory 106 can be programmed with computer readable data representing instructions executable by processor 102 for performing the methods described below as well as other variants that are anticipated but not specifically listed.

Engine 10 may further include a boost system and/or device such as a turbocharger or supercharger including at least a compressor (not shown) arranged along intake manifold 44. For a turbocharger, the compressor may be at least partially driven by a turbine (e.g. via a shaft) arranged along exhaust passage 48. For a supercharger, the compressor may be at least partially driven by the engine and/or an electric machine, and may not include a turbine. Thus, the amount of air charge provided to one or more cylinders of the engine via a turbocharger or supercharger may be varied by controller 12. Further, a compressor 150, which may be included in the boost systems described above, is coupled (via a dashed line) to an air passage of the crankshaft to supply pressurized air, as described in more detail below.

As described above, FIG. 1 shows only one cylinder of a multi-cylinder engine, and that each cylinder may similarly include its own set of intake/exhaust valves, fuel injector, spark plug, etc.

Figure 2:
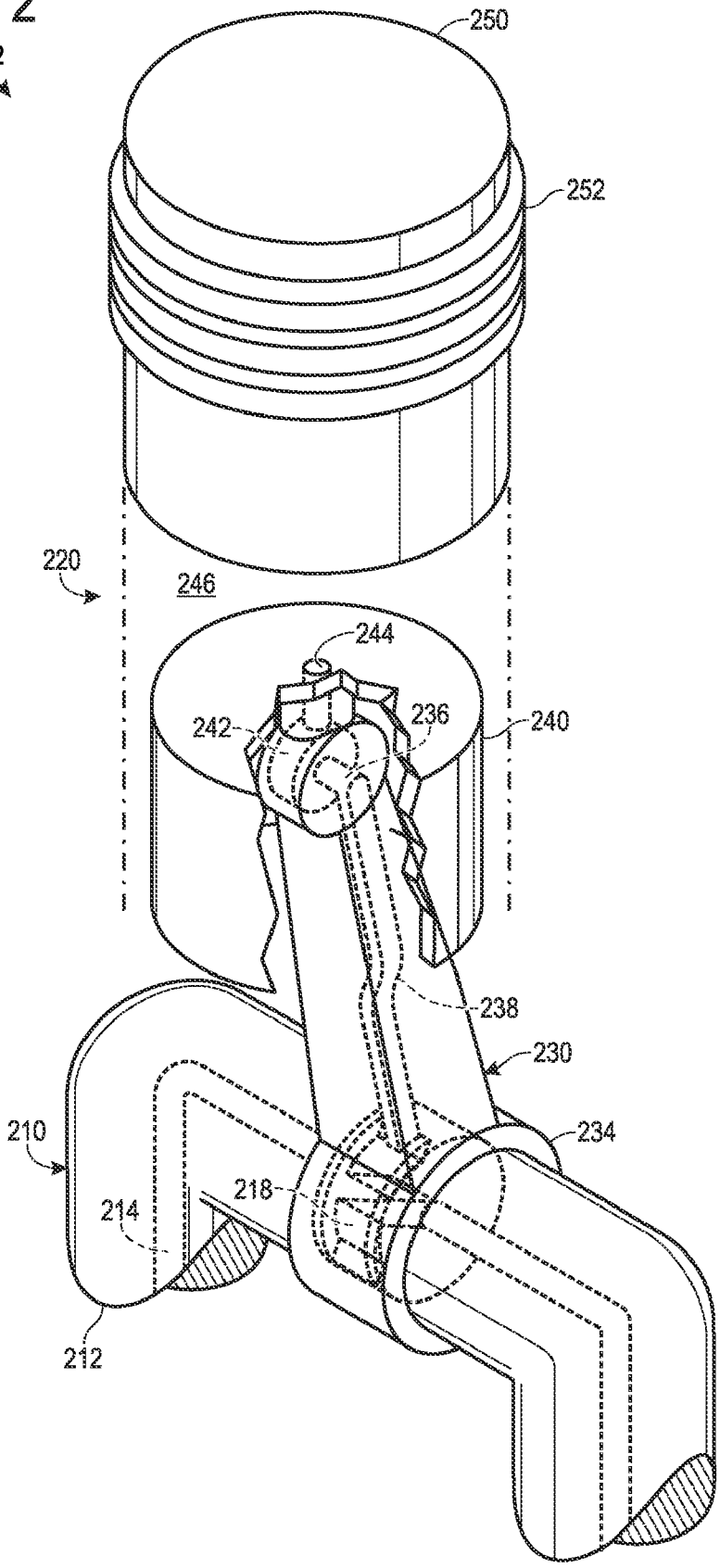
FIG. 2 is a partial cut away view of a system for controlling a variable compression ratio with a piston-in-piston.

FIG. 2 is a partial cut away view of a system 202 for controlling a variable compression ratio with a piston-in-piston 220. The system may be integrated into an engine, for example engine 10, by being placed inside a cylinder, one example of which is cylinder 30. The system 202 further includes a crankshaft 210, which is one example of crankshaft 40. Piston-in-piston 220 is one example of a piston assembly and is an example of piston 36. The piston-in-piston includes an outer piston 250 and an inner piston 240. The piston-in-piston is further rotatably coupled to the crankshaft via a connecting rod 230, as described above at FIG.1. An air duct 238 is built into the connecting rod 230 and may coincide with (i.e., be in contact with) an air passage connection 218.

The crankshaft 210 includes a pressurized air passage 214 disposed inside a crankshaft body 212. The pressurized air passage may be an air passage of the crankshaft. The crankshaft may include more than one air passage to be in fluid communication with piston assemblies in more than one cylinder. Additional valves (not shown) to control air pressure in the pressurized air passage 214 may be included in system 202. In one example, a valve is disposed within the crankshaft body 212, the valve being an interface between the air duct 238 and the pressurized air passage 214. In another example, a valve is coupled to an end of the crankshaft 210. In yet another example, a valve controls a level of pressure in the pressurized air passage 214 during a portion of the engine cycle. In yet another example, a valve controls a filling timing of the air duct. For example, the valve may control the filling timing to correspond to the engine cycle timing.

In some embodiments, the system 202 may have a pressure source and pressure sensors. The pressure source may be a compressor, for example the compressor in a boost system mentioned above in FIG. 1 as part of a turbocharger or supercharger. In some examples, the compressor is coupled to the pressurized air duct. Further, the pressure source may be controlled by an engine control unit, for example controller 12, to set a pressure level in the pressurized air passage 214. In this way, the compressor may pressurize air in the system 202 during portions of the engine cycle. In some embodiments, a pressure sensor may be included in system 202. The pressure sensor may be disposed inside pressurized air passage 214, air duct 238 or coupled to crankshaft 210. The pressure sensor may function in a manner similar to manifold air pressure sensor 122. Inclusion of the pressure source and pressure sensors may enhance the control and monitoring of pressure in engine system 202.

Continuing with FIG. 2, the air passage connection 218, is further included in the crankshaft 210 and may enable barometric (fluid) communication with the pressurized air passage 214. The air passage connection 218 is arranged along a portion of an outer arc of the crankshaft 210, with a radial passageway extending inward to communicate with the pressurized air passage 214. The crankshaft 210 may rotate inside a rod and shaft coupling 234 and the air passage connection 218 may change position relative to the air duct 238. In this way, the air passage connection 218, including an arc portion of the crankshaft 210 may align with the air duct 238 of the connecting rod 230 and establish fluid communication. In the present example, the air duct and air passage connection are shown to be in contact with one another. In this example, pressure may be communicated from the pressurized air passage to the air duct to enable filling. In alternate examples, the air duct and air passage connection may not be in contact with one another. In this way, the connecting rod 230 may be isolated from the pressurized air passage 214. Thus, a filling timing of the air duct may be controlled to a predetermined crankshaft angle position and/or a predetermined engine cycle timing.

The connecting rod 230 includes the air duct 238, a rod and shaft coupling 234 and a duct connection 236. Air pressure may be communicated through the connecting rod 230, via air duct 238 to a duct connection 236. In some examples, the air duct is a bore drilled into the connecting rod. In other examples, the air duct is molded as part of the connecting rod. Duct connection 236 couples to inner piston 240 via the piston and rod coupling 242. In the present example, piston and rod coupling 242 may enable a piston's reciprocating motion to be converted into rotational motion of the crankshaft, as described above at FIG. 1. Further, piston and rod coupling 242 and duct connection 236 may enable the communication of pressure from air duct 238 through air duct opening 244. In some examples of system 202, valves are included in piston and rod coupling 242 to control filling of pressurized air through air duct opening 244. Thus, rod and shaft coupling 234 may enable contact between the pressurized air passage 214 and the air duct 238.

In the present example, a space 246 is located between the inner piston 240 and the outer piston 250. The outer piston includes engine seals 252. Outer piston 250 may be hollow and may slide over inner piston 240 enclosing it, as illustrated by dashed lines. In this way, the inner piston 240 may be variably positioned inside the outer piston 250. In some examples, the outer piston may retain the inner piston from sliding out of the outer piston via a snap ring, screw threading, telescoping lock disposed inside the outer piston, and/or any other suitable retaining mechanism. In other examples, the piston-in-piston 220 may include addition travel limiting devices and features for limiting the vertical upward travel of the outer piston relative to the inner piston. The space 246 in between the inner piston 240 and the outer piston 250 may be air tight and defined collectively to form an auxiliary chamber.

The auxiliary chamber is a variable-volume auxiliary chamber, and may be filled with pressurized air through air duct opening 244. In examples where the inner piston is retained inside the outer piston, the auxiliary chamber may have a maximum volume. Further, the auxiliary chamber may change in volume in response to combustion pressure, compression pressure and pressurized air fluidly communicated from pressurized air passage 214 through air duct 238 and duct opening 244.

It may be appreciated that a pressurized air system need not require engine block modifications or additional systems to employ a variable compression ratio control. Further, a pressurized air system may easily be incorporated with other engine systems and components, for example a compressor in a boost system. Further still, a pressurized air system may help improve the operation of an engine by maintaining or increasing an effective compression ratio under low loads.

FIGS. 3-8 show a cylinder 300 including a system 302 for controlling a variable compression ratio with a piston-in-piston 320 during part of a four stroke engine cycle. The system 302 is one example of system 202 described above at FIG. 2. The system includes an inner piston 340 disposed in an outer piston 350, and an auxiliary chamber 346 between the inner piston and outer piston. A snap ring 348 disposed inside the outer piston 350 may be an example travel limiting feature for retaining the inner piston 340 and limiting the vertical upward travel of the outer piston 350 relative to the inner piston 340. Further, the system includes a connecting rod 330, coupling a crankshaft 310 to the inner piston via shaft and rod coupling 334 and piston and rod coupling 342.

The inner piston, outer piston, and cylinder walls collectively define a combustion chamber 364. The cylinder may further include an intake manifold 360, intake valve 362, fuel injector 366, spark plug 368, exhaust valve 370, and exhaust passage 372 as examples of engine components described above in engine 10 at FIG. 1.

FIGS. 3-8 illustrates how the filling of auxiliary chamber 346 with pressurized air via an air passage connection 318, may be timed. Further, movement through the engine cycle of system 302 is illustrated. The filling of the auxiliary chamber 346 on a down stroke, for example an admission stroke, may enable the auxiliary chamber to reach a maximum volume and an initial pressure. The initial pressure may be a pressure which produces an effective compression ratio and a correlated effective compression pressure. Further, in the present example, the filling of the auxiliary chamber may take place once during every engine cycle, enabling easy and responsive control of a variable compression ratio. Thus, filling may change a final volume of combustion chamber 364 and control a resulting effective compression ratio.

Further still, due to the filling of the auxiliary chamber, the piston-in-piston may act as an air cushion, improving anti-knock characteristics of the system as discussed below at FIGS. 9, 10 and 14. Thus, the filling of the auxiliary chamber may reduce or prevent pressure increases that result in knock in the combustion chamber.

Figure 3:
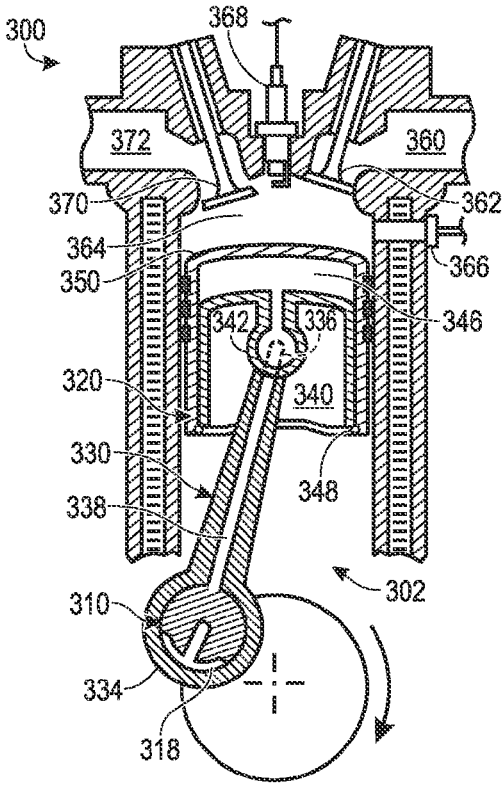
FIGS. 3-8 illustrate a cylinder, including a system for controlling a variable compression ratio, during parts of a four stroke engine cycle.

Referring now to FIG. 3, the position of the piston-in-piston 320 before TDC may indicate that the cylinder 300 is in an up stroke. The opened state of the exhaust valve may indicate that the up stroke is an exhaust stroke. In the present example, exhaust may be expelled from the combustion chamber under the pressure exerted by outer piston 350 of system 302. Air passage connection 318 may be isolated from the air duct 338 and the auxiliary chamber 346, disabling the communication of pressurized air, as described above in FIG. 2.

Figure 4:
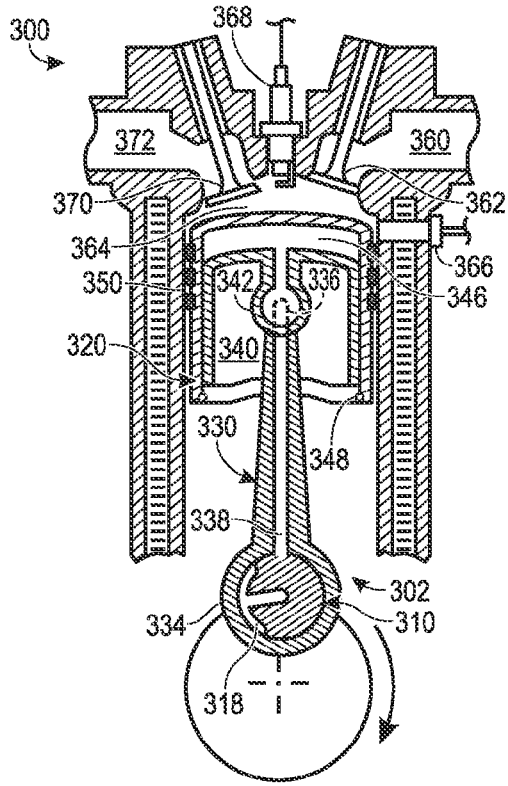

Referring now to FIG. 4, the position of the piston-in-piston is at TDC. The cylinder may be in between the exhaust and admission strokes. In the present example, the exhaust valve is not in a completely closed state and the intake is shown completely closed. In some examples, exhaust valve timing and intake valve timing may be different. Auxiliary chamber 346 is shown isolated from air passage connection 318, as described above. Further, in the present example, auxiliary chamber 346 and combustion chamber 364 may decrease in volume. This may be due to, for example, an increase in pressure in the auxiliary chamber and combustion chamber. In some examples of the four stroke engine cycle, the auxiliary chamber may not decrease in volume when completing an up stroke, or may minimally decrease.

It may be noted that as the crankshaft 310 turns, the location of the air passage connection 318 may change relative to the air duct, as shown in the difference between FIG. 3 and FIG. 4.

Figure 5:
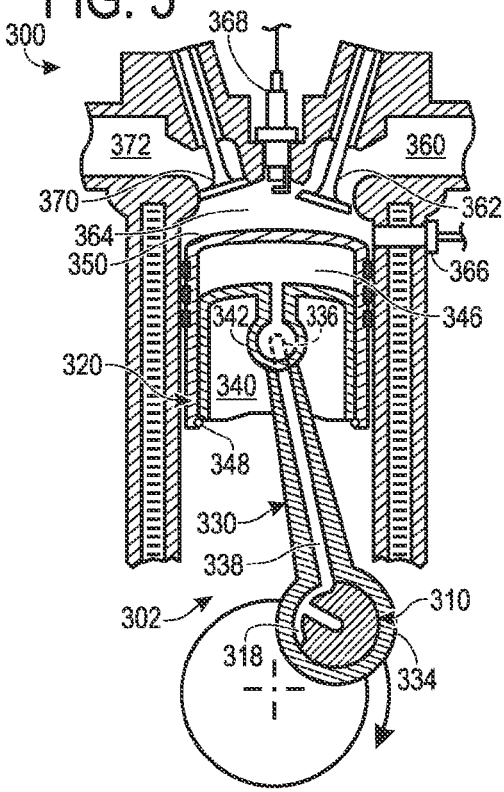

Referring now to FIG. 5, the piston-in-piston 320 is positioned after TDC, which may indicate that the cylinder is in a downward stroke. The open intake valve 362 may further indicate that the cylinder 300 is in an admission stroke, when air charge is increased inside the cylinder. An arc portion of the air passage connection 318 is shown aligned with the air duct 338 of the connecting rod 330. In this way, the air passage connection may begin to coincide with the air duct 338, enabling the filling of the air duct and auxiliary chamber 346 to an initial pressure. A compressor further coupled to the system, as described above at FIG. 2, may pressurize air during portions of the engine cycle before, during or after such an alignment. The initial pressure may be greater than, less than, or the same as the pressure of the previously isolated auxiliary chamber pressure, for example, the pressure of the auxiliary chamber in FIG. 3, and/or FIG. 4. The filling of the auxiliary chamber may occur as the auxiliary chamber reaches a maximum volume. Further, the acceleration of the outer piston may cause it to separate from the inner piston, facilitating the filling of the auxiliary chamber to the initial pressure.

In alternate examples, additional valves, as described above, may be used to control pressurized air communication to the auxiliary chamber 346. For example additional valves may be used to ensure that the filling timing is during an admission stroke. In further examples valves may be used to further control a level of pressure, during filling of the auxiliary chamber to the initial pressure.

In further examples, the filling timing may be different than the one depicted in FIGS. 3-8. In some such examples, the filling timing may take place during all or part of an up stroke, for example a compression stroke or an exhaust stroke. In some such examples, the orientation of the air passage connection 318 along an arc of the crankshaft 310 and the timing when the air passage connection coincides with the air duct 338 are different. However, filling on an up stroke may require more energy, for example, because of the inertia of the piston-in-piston 320 reducing the separation between the outer piston 350 and inner piston 340, and thus reducing auxiliary chamber volume. Further still, the force on the outer piston 350 may increase with the square of the engine speed, which may lead to a need for greater pressures in a pressurized air passage under high engine loads. In this way it may be detrimental for filling timing to take place during all or part of an upstroke.

Figure 6:
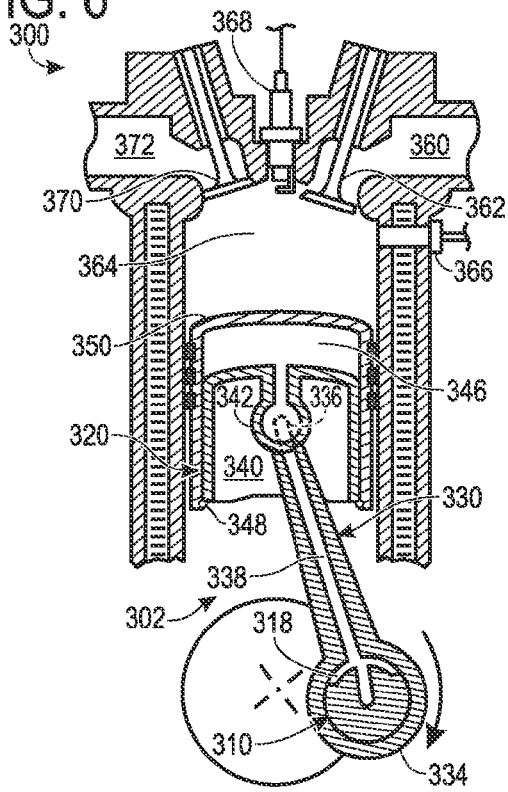

Referring now to FIG. 6, the cylinder 300 continues through the admission stroke, and the air duct 338 continues to coincide with air passage connection 318. Continued filling of the air duct and the auxiliary chamber may result, as described above at FIG. 5. Crankshaft position may have rotated relative to the position indicated in FIG. 5, causing the air passage connection 318 to rotate relative to the air duct 338. The acceleration and downward motion of the piston-in-piston 320 may facilitate the filling of the auxiliary chamber 346 to the initial pressure and enable the auxiliary chamber to reach a maximum volume.

Figure 7:
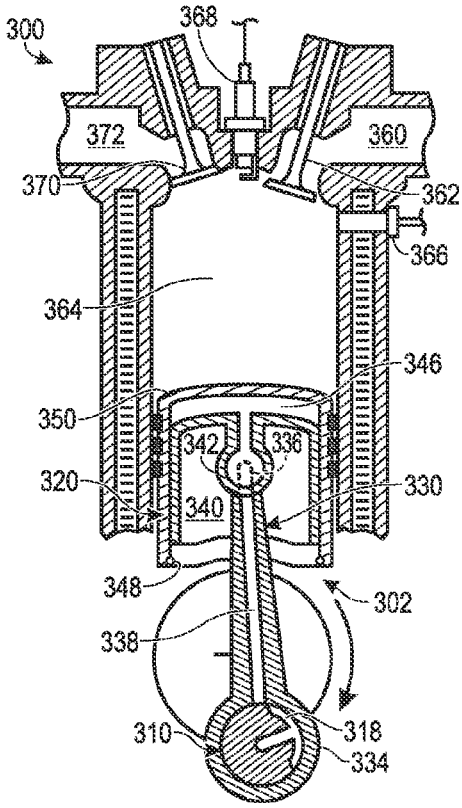

Referring now to FIG. 7, the position of the piston-in-piston 320 may be right before BDC, at the end of a down stroke. In the present example, the intake valve 362 is in a partially closed state, further indicating the end of the admission stroke. The air passage connection is shown to not coincide with the air duct, controlling the filling timing. The filling duration may be long enough such that the auxiliary chamber and air duct obtain a barometric equilibrium with a pressurized air passage via the air passage connection. After filling, the auxiliary chamber and air duct may be isolated.

In the present example down stroke, the auxiliary chamber volume is shown to be reduced, for example due to the inertia of the downwardly accelerating outer piston. In some examples, other pressures may act to reduce the auxiliary chamber volume, such as combustion pressure during a power stroke. In further examples, the auxiliary chamber may not decrease in volume when ending a down stroke, or may minimally decrease.

Figure 8:
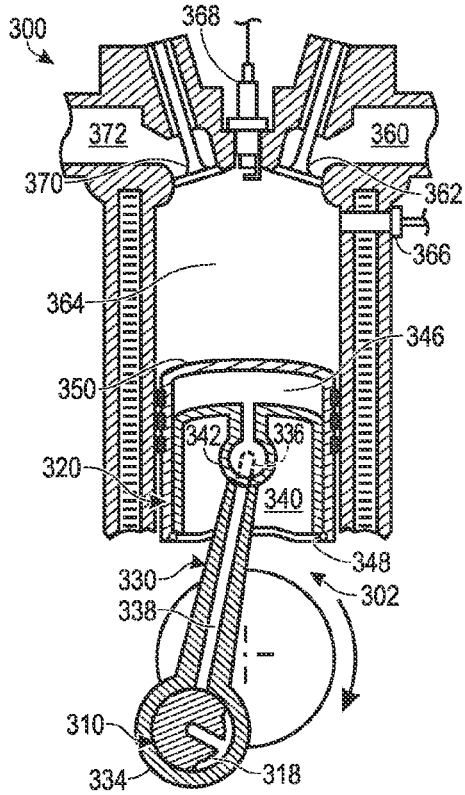

Referring now to FIG. 8, the position of the piston-in-piston 320 after BDC may indicate that the cylinder 300 is beginning an up stroke. In the present example, the auxiliary chamber 346 and air duct are isolated from the air passage connection 318 and may be at an initial pressure. Further, the combustion chamber may be sealed by the closing of both the intake valve 362 and the exhaust valve 370. The increase in air charge enabled by the open intake valve, described above at FIG. 5, may begin to be compressed by the rising of piston-in-piston 320.

As the system continues through the compression stroke, the volume of the combustion chamber and auxiliary chamber may decrease. Further, the pressure in the auxiliary chamber may increase above the initial pressure. The combustion chamber volume and combustion chamber pressure when the system reaches TDC may be determined by the initial pressure in the auxiliary chamber, as described in further detail in FIGS. 4, and 9-12 for example. The initial pressure may determine the change in combustion chamber volume, and resulting effective compression ratio.

Figure 9:
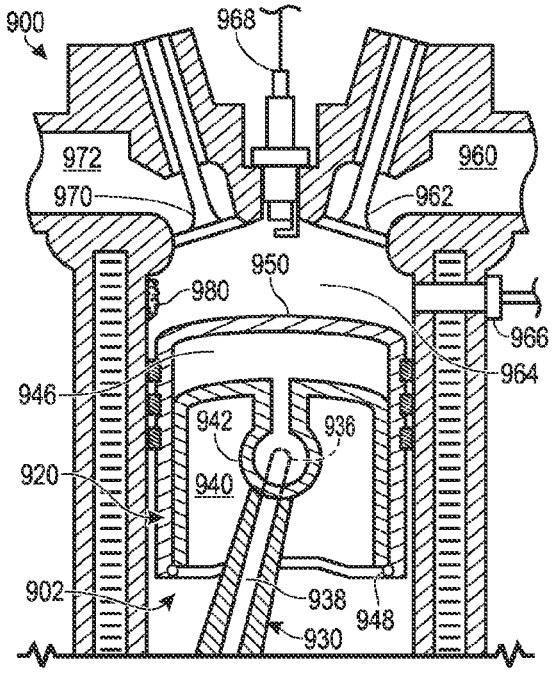
FIG. 9 illustrates a system for controlling a variable compression ratio in a compression stroke, before a knock.
Figure 10:
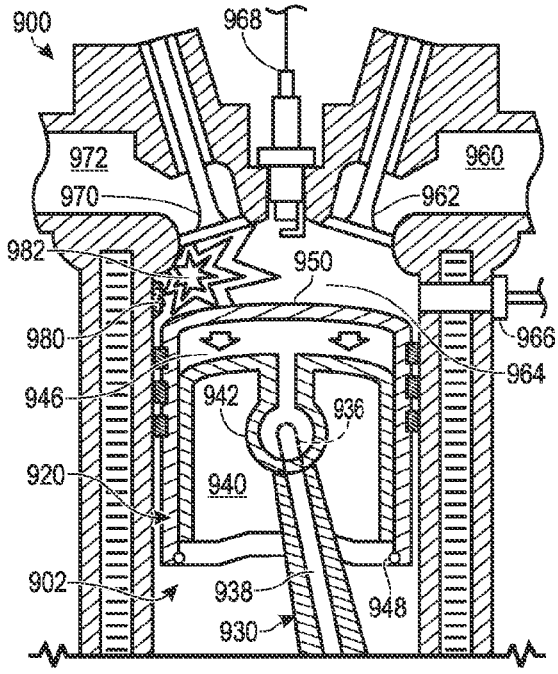
FIG. 10 illustrates a system for controlling a variable compression ratio in a power stroke, responding to a knock.

FIGS. 9 and 10 are schematic illustrations of a cylinder 900 including a system 902 for controlling a variable compression ratio before and after TDC following a compression stroke. The system 902 is one example of system 302 of FIGS. 3-8. The system includes an inner piston 940 disposed in an outer piston 950, and an auxiliary chamber 946 between the inner piston and outer piston. A snap ring 948 disposed inside the outer piston 950 may be an example travel limiting feature and is one example of snap ring 348 described above. Further, the system includes a connecting rod 930, coupling a crankshaft 910 to the inner piston via shaft and rod coupling 934 and piston and rod coupling 942. The cylinder may further include an intake manifold 960, intake valve 962, a combustion chamber 964, a fuel injector 966, a spark plug 968, an exhaust valve 970, and an exhaust passage 972. The example cylinder further includes an engine deposit 980.

FIG. 9 shows the outer piston 950 act to compress a charge in the combustion chamber 964 before a knock. As the combustion chamber volume and the auxiliary chamber volume decrease, the combustion chamber pressure and auxiliary chamber pressure increase. The auxiliary chamber 946 may have been filled to an initial pressure, resulting in an effective compression pressure on the charge at the end of compression. Thus, a charge is compressed to a desired effective compression pressure and correlated desired effective compression ratio.

FIG. 10 shows the outer piston 950 under combustion pressure. The combustion pressure may be due to a knock, 982, which may be a detonation or an uncontrolled explosion. In the present example, knock may result from the engine deposit 980 heating air, or a fuel and air mixture. The air or fuel and air mixture may be heated in an undesired manner to a combustion temperature. As combustion pressure acts on the piston-in-piston 920, the outer piston may respond by moving toward the inner piston, causing a decrease in auxiliary chamber volume.

Air inside the auxiliary chamber may cause the auxiliary chamber to act as an air cushion, preventing a large and/or damaging pressure increase in the combustion chamber 964. The arrows inside the auxiliary chamber 946 illustrate a direction of downward force acting on the outer piston 950 and the auxiliary chamber. Some part of the force may act on air inside the auxiliary chamber, redistributing the pressures on system 902 and the cylinder 900 to absorb shock. In some examples, a detonation, knock, or other increase in cylinder pressure may occur before the system reaches TDC, and the auxiliary chamber may smooth out combustion pressure build up in a similar manner. In still further examples, the auxiliary chamber may smooth out an increase in cylinder pressure, without a detonation or other damaging pressure increase in the combustion chamber 964.

Figure 11:
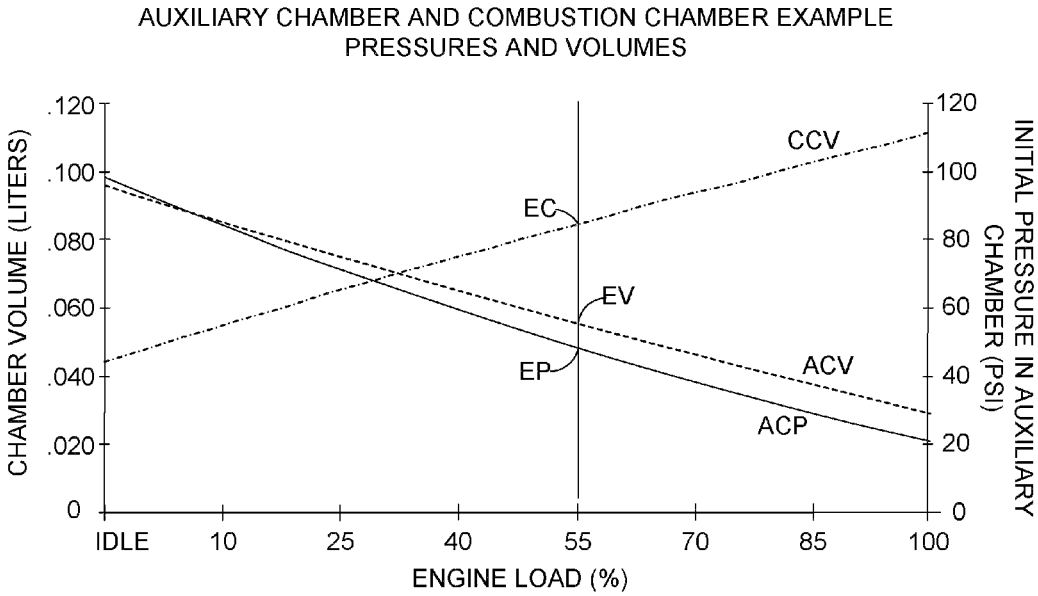
FIG. 11 shows a graph depicting a relationship between an initial pressure in an auxiliary chamber, an auxiliary chamber compression volume and a combustion chamber compression volume (effective compression ratio).

FIG. 11 shows a graph depicting a relationship between an initial pressure in an auxiliary chamber, an auxiliary chamber compression volume and a combustion chamber compression volume. The auxiliary chamber may be included in a system for controlling a variable compression ratio, for example systems 202, 302, and 902. The combustion chamber may be disposed in a cylinder, for example, cylinders 30, 300 and 900. Given an initial combustion chamber volume (cylinder displacement volume), a charge of air or air and fuel, and the combustion chamber compression volume, an effective compression ratio and correlated effective compression pressure may be determined. Further, the combustion chamber compression volume may be determined, at least in part, by the initial pressure in the auxiliary chamber and resulting auxiliary chamber volume. In this way, auxiliary chamber volume may at least partially determine the compression chamber volume. Thus adjusting pressure in the auxiliary chamber may produce a desired effective compression ratio and effective compression pressure.

In the present example, a maximum auxiliary chamber volume is 0.2 liters, the cylinder displacement volume is 1 liter, the desired effective compression ratio is 10:1 and the correlated desired effective compression pressure is 258 pounds per square inch (psi). The system may be assumed to be isentropic. Further, the relationship may be a calculation that may be stored as a function or a lookup table in a read only memory, for example read-only memory 106. It should be noted that alternate effective compression ratios, for example an effective compression ratio that is not 10:1, may require alternate effective compression pressures which in turn may be reflected in different calculations, volumes and pressures.

The graph shows the possible values for correlated initial pressure filled in an auxiliary chamber in solid line ACP, resulting compression chamber volume in dash-dot line CCV and resulting auxiliary chamber volume in dash-dash line ACV over a range of engine loads that correlate with the example 10:1 effective compression ratio. For example, an engine load may be 55%, resulting in example initial pressure EP of 48 psi, compression chamber volume EC 0.084 liters and auxiliary chamber volume EV 0.056 liters. In another example, engine load may be 25%, resulting in a correlated initial pressure of 71 psi, a correlated combustion chamber volume of 0.065 liters and a correlated auxiliary volume of 0.075 liters. Thus, the relationship may enable a prediction of a desired initial pressure filled in auxiliary chamber to obtain a 10:1 effective compression ratio and 258 psi effective compression pressure, regardless of engine load.

Figure 12:
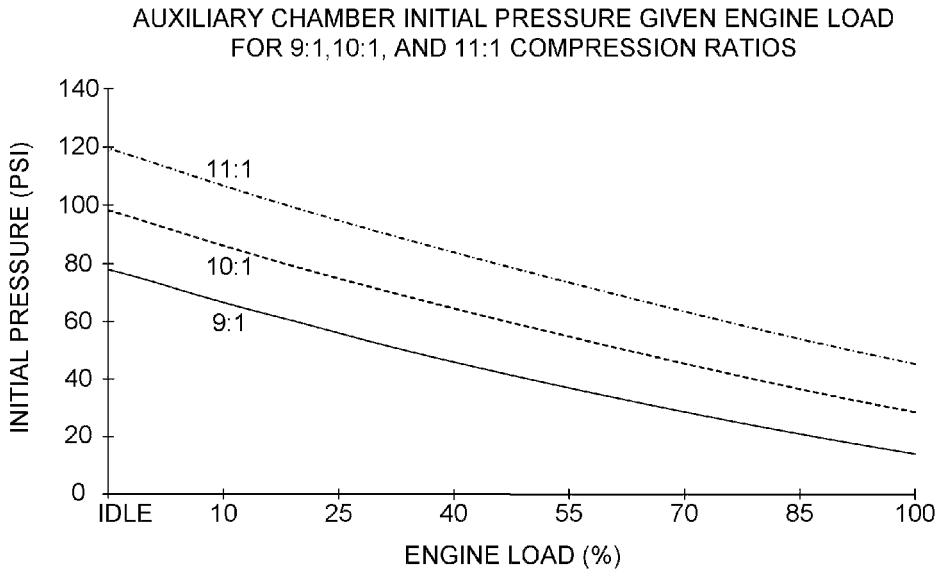
FIG. 12 shows a graph depicting how initial pressure of an auxiliary chamber depends on engine load to obtain desired effective compression ratios.

Referring now to FIG. 12, a graph shows initial pressures filled in an auxiliary chamber correlated to three effective compression ratios, 9:1, 10:1, and 11:1 respectively, over a range of engine loads. The auxiliary chamber may be included in a system for controlling a variable compression ratio, for example systems 202 and 302. The initial pressure of the auxiliary chamber may determine an effective compression ratio and effective compression pressure as described above.

Solid line 9:1, dash-dash line 10:1 and dash-dot line 11:1 may represent correlated initial pressures filled in an auxiliary chamber resulting in 9:1, 10:1 and 11:1 effective compression ratios, respectively. Lines 9:1, 10:1 and 11:1 may be calculated in a manner similar to line ACP in FIG. 11. In the present example, the maximum auxiliary chamber volume is 0.2 liters and the cylinder displacement volume is 1 liter. In alternate examples, the auxiliary chamber volume and displacement cylinder volume may be larger or smaller according to engine size, expected engine operating conditions of charge, engine speed and load, performance demands, etc. Further, lines 9:1, 10:1 and 11:1 may have relationships between initial pressures and correlated effective compression ratios stored as a function or a lookup table in a read only memory, for example read-only memory 106.

The line 9:1 shows a desired initial pressure filled in an example auxiliary chamber to obtain an effective compression ratio of 9:1 across a range of engine loads. Similarly, lines 10:1 and 11:11 show desired initial pressures filled in the auxiliary chamber to obtain the same (constant) effective compression ratios of 10:1 and 11:1 respectively, across a range of engine loads. In further examples, initial pressures filled in the auxiliary chamber include alternate effective compression ratios and effective compression pressures. Consequently, a system may be operated to switch between effective compression ratios and effective compression pressures without regard to engine load. In alternate examples it should be note that the maximum auxiliary chamber volume may be larger to accommodate higher loads at lower effective compression ratios.

Figure 13:
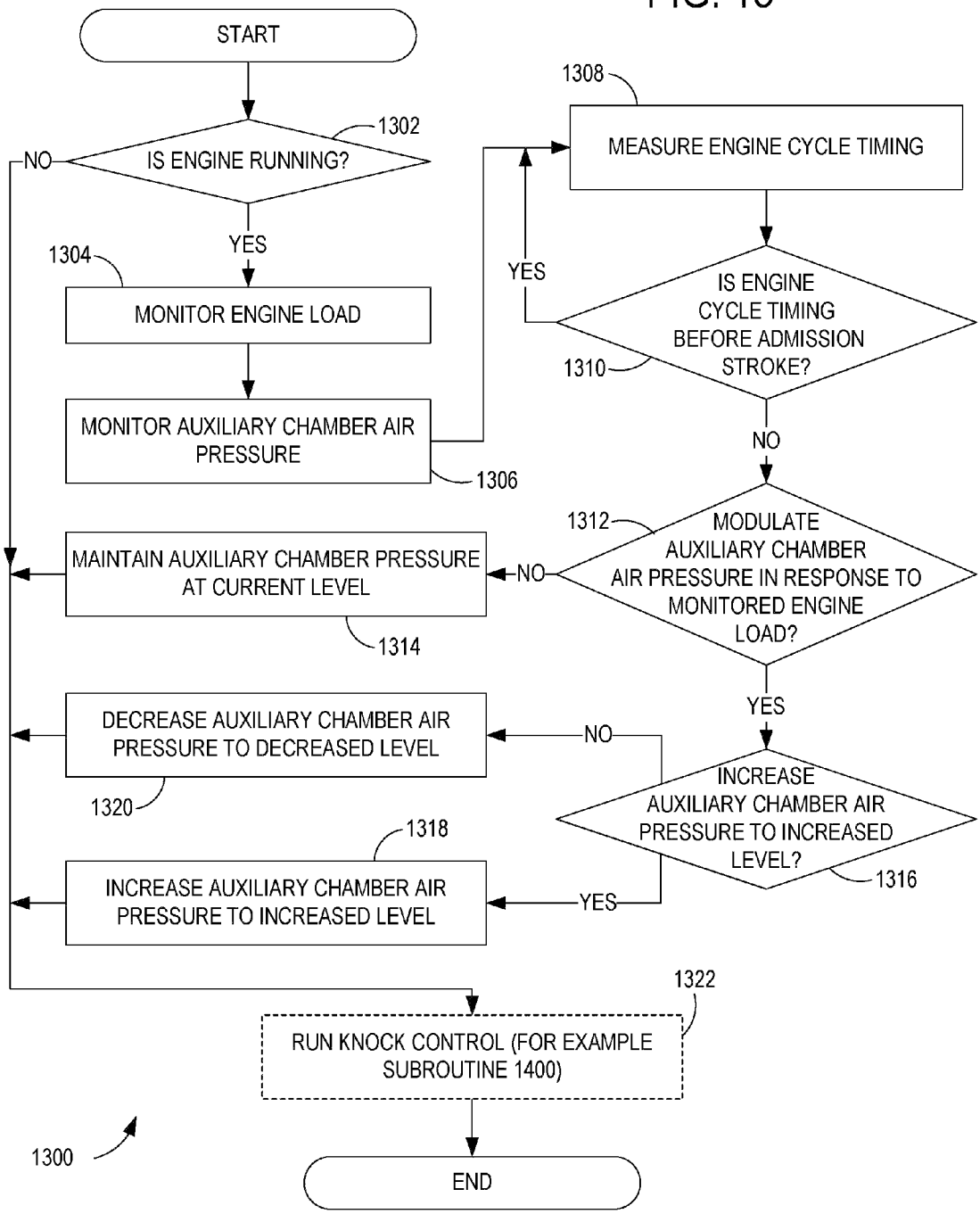
FIG. 13 shows an example routine for carrying out a method of controlling a variable compression ratio.

FIG. 13 and 14 show a routine 1300 and subroutine 1400, respectively, for operating a system for controlling a variable compression ratio, for example systems 202, 302, and 902. The system may be disposed inside a cylinder, for example cylinder 30, 300 or cylinder 900. The system may include an engine controller, for example ECU 12, which may carry out operation of the routine and/or the subroutine. Further, 1300 and subroutine 1400 may be considered single iterations of a loop, to be repeated, enabling continuous control of a variable compression ratio. Further still, 1300 and 1400 may be included in further routines for control of an engine. It should be appreciated that use of routines such as routine 1300 and subroutine 1400 may increase engine efficiency and lead to fuel economy improvements, for example at partial loads.

FIG. 13 shows a routine 1300 for carrying out a method of operating a system for controlling a variable compression ratio. The routine may be used to control for a specific effective compression ratio by changing air pressure in an auxiliary chamber of the system. In some examples, routine 1300 may be included in a routine for determining a desired effective compression ratio. For example, a desired effective compression ratio may be determined by engine operating conditions like engine speed, engine temperature, engine load, use of a boost device, etc. Further, a desired effective compression ratio may be determined by performance demands, for example by an operator's use of input device 130.

Routine 1300 may begin at 1302 with it may be determined if the engine is running. Running the engine may include applying spark to a mixture of fuel and air, for example charge, to generate energy to move a vehicle. If the engine is not running, the routine ends. In alternate examples, the routine may continue on, or 1302 may be omitted.

The routine may continue on to 1304, where engine load is monitored. Engine load many be monitored by sensing engine conditions such as a manifold air mass, manifold air pressure, throttle position, engine speed, and the like. Sensed engine conditions may be inputted into a lookup table to determine engine load, for example a look up table in read only memory 106. In some examples, sensed engine conditions may be inputted into a function or used in a calculation to determine engine load.

Next, the routine may continue on to 1306, where auxiliary chamber air pressure may be monitored. Monitoring auxiliary chamber air pressure may include storing an initial pressure filled into the auxiliary chamber in a random access memory, for example random access memory 108, for recovery at a later time. Further, monitoring auxiliary chamber air pressure may include directly sensing auxiliary chamber air pressure with a barometric pressure sensor. Such a sensor may be disposed, for example, inside an air duct built into the connecting rod or in the auxiliary chamber.

At 1308, the routine may continue to measure crankshaft angle position. Measuring engine cycle timing may include measuring a crankshaft angle position and valve timing as described above at FIG. 1. In alternate examples of the routine, the process may be skipped, or another process for determining the engine cycle timing may be employed.

At 1310, the routine may determine if engine cycle timing is before an admission stroke. This may be done to enable filling of the auxiliary chamber during the admission stroke. In some examples of the routine, crankshaft angle position may only be used to determine if the engine cycle is entering a down stroke. If the engine cycle timing is before the admission stroke then the routine may return to 1308 to measure engine cycle timing. In some examples of the routine, the routine may end.

If the engine cycle timing is not before the admission stroke, then the routine may continue next to 1312, to determine whether to modulate (adjust) auxiliary chamber air pressure in response to monitored engine load. Modulating air pressure may include increasing air pressure and decreasing air pressure. The determination may be based on conditions and information obtained in a process to monitor engine load and auxiliary chamber air pressure, for example at 1304, and 1306. The determination may be made, at least in part, by information stored as a function or as data in a lookup table. For example, such information may include the lines of the graphs of FIGS. 11 and 12. In some examples, auxiliary chamber air pressure may be modulated as a response to knock. In other examples, auxiliary chamber air pressure may be modulated in response to decreasing or increasing engine load. In still other examples the determination may be based on the input of a user depressing a pedal, for example 130, to increase engine performance. From the determination, the initial pressure in the auxiliary chamber may increase or decrease and thus change an effective compression ratio.

If the determination is made not to modulate auxiliary chamber air pressure in response to monitored engine load, then the routine may continue on to 1314 where auxiliary chamber pressure may be maintained at a current level. In some examples, the current level may be the initial pressure filled into the auxiliary chamber in a previous down stroke. In some examples of the routine, maintaining auxiliary chamber pressure at the current level may include closing valves coupled to a pressurized air passage or an air duct.

In some examples, after auxiliary chamber air pressure is maintained, the routine ends. In other examples, the routine continues on to run knock control at 1322. Running knock control may be carried out by a subroutine, for example subroutine 1400 described below. The box at 1322 is dashed to indicate the process's optional nature. After knock control is run, the routine may end.

If the determination is made to modulate auxiliary chamber air pressure in response to monitored engine load, the routine may continue to 1316, where a determination is made whether to increase auxiliary chamber air pressure to an increased level. The determination may be made in a similar manner as the determination whether to modulate auxiliary chamber air pressure. The determination may further include comparing sensed engine condition data, for example, whether engine speed, engine load, manifold air pressure, and the like are over or below threshold values. In alternate examples, the determination may be replaced by a determination to decrease auxiliary chamber air pressure. In still further examples, the determination may be included in another decision making step or process, for example the determination 1312.

If the determination is made to increase auxiliary chamber air pressure, the routine may continue to 1318, where the routine may increase auxiliary chamber air pressure to an increased level. If the determination is made not to increase auxiliary chamber air pressure, the routine may continue to 1320, where auxiliary chamber air pressure may decrease to a decreased level. The increased level and the decreased level may be initial pressures correlated to engine load and filled into an auxiliary chamber to enable an effective compression ratio or effective compression pressure, as presented in FIGS. 11, and 12. In this way, auxiliary chamber air pressure may be increased or decreased in response to monitored load conditions.

After the routine completes processes at step 1320 or 1318, the routine may continue to run knock control at 1322. One example of run knock control is subroutine 1400, described below at FIG. 14. In some examples of the routine, this process may be skipped, and the routine may end. In other examples, after the knock control has been run, the routine may end.

Referring now to FIG. 14, a subroutine for carrying out a method to smooth out combustion pressure in response to knock is shown. The subroutine may begin at 1402 by measuring engine cycle timing, which may be similar to a process described above at 1308. In some examples of the routine, the process may be skipped, or another process for determining the engine cycle timing may be employed.

Next the routine continues to a determination, 1404 of whether the engine cycle is during a compression stroke or a power stroke. This may be done to ensure that knock sensing occurs only during the portion of the engine cycle when knock occurs. In some examples of the routine, engine cycle timing may be used to determine if the engine is entering an up stroke. If the engine cycle timing is before the compression stroke or after a power stroke then the routine may return to 1402 to measure engine cycle timing. In some examples of the routine, the routine may end.

If the engine cycle timing is not during a compression stroke or a power stroke, then the routine may continue on to 1406, where it may detect if there is a knock. Knock detection may include the use of engine vibration sensors. Further, knock detection may involve directly sensing the pressure in an engine cylinder or other knock detection methods and/or routines. Further still, a sensor coupled to a pressurized air passage in a crankshaft, an air duct in a connecting rod and/or an auxiliary chamber may be used to sense pressure changes in a combustion chamber. In the present example, if knock is not detected, the routine may end. In some examples, the subroutine may include processes to monitor the engine cycle timing, for example by a crankshaft position angle, determining if the engine is still in a compression or power stroke and then returning to 1406 to determine if there is knock.

If knock is detected then the subroutine may continue on to 1410 where it may cushion knock by smoothing out combustion pressure build up. Smoothing out combustion pressure build up may include using air inside the auxiliary chamber acting as an air cushion, to prevent a significant or damaging pressure increase in the combustion chamber, as described above at FIGS. 9 and 10. In some examples the subroutine may further continue to alert the presence of knock at 1412, otherwise the subroutine may end. The box at 1412 is dashed to indicate the process's optional nature. Alerting the presence of knock may include transmitting a signal from a sensor, for example an engine vibration sensor, or pressure senor to an engine controller. Altering the presence of knock may further enable a knock mitigating routine or method, after which, the routine may end.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

Figure 15:
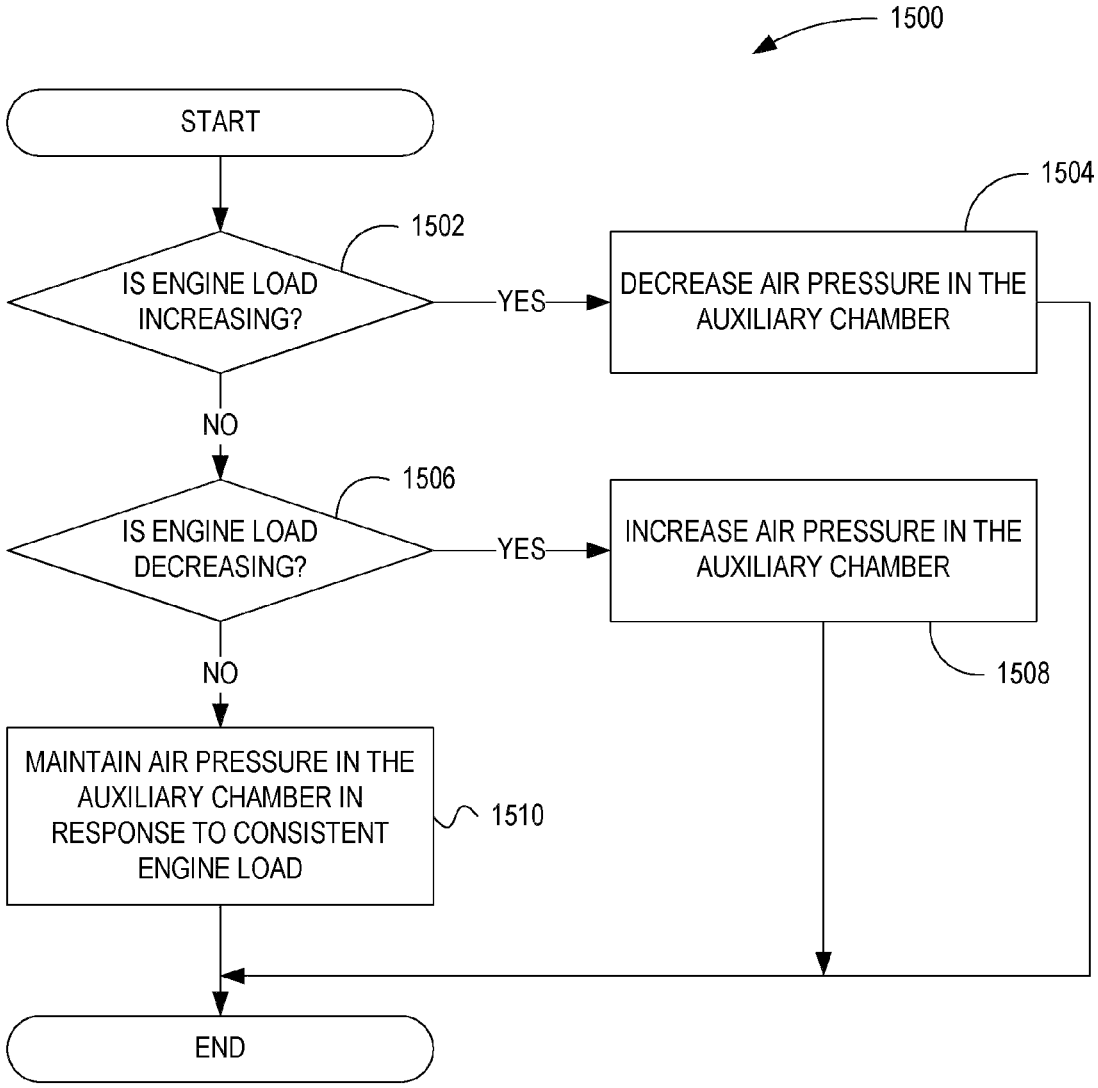
FIG. 15 shows an example method for controlling an effective compression ratio in an internal combustion engine.

FIG. 15 shows an example method 1500 for controlling an effective compression ratio in an internal combustion engine including a cylinder having a piston assembly with an auxiliary chamber, as described above. At 1502, method 1500 includes determining if an engine load is increasing. If it is determined that engine load is increasing method 1500 moves to 1504. Otherwise, the engine load is not increasing and the method moves to 1506. At 1504, method 1500 includes decreasing air pressure in the auxiliary chamber in response to decreasing engine load. At 1506, method 1500 includes determining if an engine load is decreasing. If it is determined that the engine load is decreasing method 1500 moves to 1508. Otherwise, the engine load is not decreasing and method 1500 moves to 1510. At 1508, method 1500 includes decreasing air pressure in the auxiliary chamber in response to increasing engine load. At 1510, method 1500 includes maintaining air pressure in the auxiliary chamber in response to consistent engine load. Air pressure in the auxiliary chamber may be controlled in any suitable manner, including using the pressure control systems and methods described above. It is to be understood that a process flow for assessing engine load may be altered without departing from the scope of this disclosure. In general, changes to pressure in the auxiliary chamber may be made responsive to virtually any assessed engine load.

FIG. 16 shows an example method 1600 for changing an effective compression ratio in an internal combustion engine, as described above. At 1602, method 1600 includes adjusting air pressure in a variable-volume auxiliary chamber to change an effective compression ratio in a cylinder. Air pressure in the auxiliary chamber may be controlled in any suitable manner, including using the pressure control systems and methods described above. At 1604, method 1600 includes compressing a charge in a cylinder with a piston assembly. It is to be understood that a process flow for assessing engine load may be altered without departing from the scope of this disclosure. In general, changes to pressure in the auxiliary chamber may be made responsive to virtually any assessed engine load.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system for controlling a variable compression ratio in an engine, comprising: a cylinder; an outer piston located inside the cylinder, the cylinder and the outer piston collectively defining a combustion chamber; an inner piston, variably positioned inside the outer piston, the outer piston and the inner piston collectively defining an auxiliary chamber; a connecting rod including an air duct in fluid communication with the auxiliary chamber; and a crankshaft including an air passage in fluid communication with the air duct of the connecting rod during at least a portion of an engine cycle; further comprising a compressor to pressurize air in the air passage of the crankshaft.

2. The system of claim 1, wherein the compressor pressurizes air in the auxiliary chamber during portions of the engine cycle in which the air passage of the crankshaft is in fluid communication with the air duct of the connecting rod.

3. The system of claim 1, further comprising a controller for setting a pressure level in the air passage of the crankshaft.

4. The system of claim 3, wherein the controller sets the pressure level in the air passage of the crankshaft so that a pressure in the auxiliary chamber produces a desired effective compression ratio.

5. The system of claim 3, wherein said controller decreases said pressure level in response to an increasing engine load.

6. The system of claim 3, wherein said controller increases said pressure level in response to a decreasing engine load.

7. The system of claim 1, wherein the air passage connection of the crankshaft includes an arc portion along an outer arc of the crankshaft.

8. The system of claim 7, wherein alignment of the arc portion of the air passage with the air duct of the connecting rod establishes fluid communication during a filling portion of the engine cycle.

9. The system of claim 8, wherein said filling portion occurs at least during a portion of a down stroke.

10. The system of claim 1, further comprising a boost system including at least a compressor to increase a mass of air entering the cylinder.

11. A method, comprising:

adjusting an effective compression ratio in an internal combustion engine including a cylinder having an inner piston positioned inside an outer piston to collectively define a variable-volume auxiliary chamber between the inner and outer pistons, and increasing air pressure in the auxiliary chamber in response to decreasing engine load.

12. The method of claim 11, further comprising decreasing air pressure in the auxiliary chamber in response to increasing engine load.

13. The method of claim 11, further comprising maintaining air pressure in the auxiliary chamber in response to consistent engine load.

14. The method of claim 13, further comprising decreasing air pressure in the auxiliary chamber in response to increasing engine load.

15. A method for operating an engine, comprising:

compressing a charge in a cylinder with a piston assembly including an inner piston positioned inside an outer piston and collectively defining a variable-volume auxiliary chamber; and adjusting air pressure in the auxiliary chamber to change an effective compression ratio of the cylinder.

16. The method of claim 15, wherein adjusting air pressure in the auxiliary chamber includes increasing air pressure in the auxiliary chamber responsive to decreasing engine load.

17. The method of claim 15, wherein adjusting air pressure in the auxiliary chamber includes decreasing air pressure in the auxiliary chamber responsive to increasing engine load.

18. The method of claim 15, wherein adjusting air pressure in the auxiliary chamber occurs during a down stroke of the piston assembly.

19. The method of claim 15, wherein adjusting air pressure in the auxiliary chamber includes opening and/or closing a valve including an interface between an air duct and an air passage.

20. An engine, comprising:

an outer piston located inside a cylinder and together with the cylinder defining a combustion chamber;

an inner piston, variably positioned inside the outer piston, and together with the outer piston defining an auxiliary chamber;

an air duct, positioned inside a connecting rod, fluidly communicating with the auxiliary chamber; and an air passage, positioned inside a crankshaft, fluidly communicating with the air duct during only a portion of an engine cycle.

* * * * *